US009283765B2

(12) United States Patent
Takeuchi et al.

(10) Patent No.: US 9,283,765 B2
(45) Date of Patent: Mar. 15, 2016

(54) LIQUID EJECTING APPARATUS

(71) Applicant: SEIKO EPSON CORPORATION, Tokyo (JP)

(72) Inventors: Hiroshi Takeuchi, Matsumoto (JP); Hiroyuki Yoda, Shirojiri (JP); Kenji Oshima, Minowa-machi (JP); Yoshisada Aoki, Azumino (JP); Satoshi Shimizu, Shiojiri (JP); Kazutoshi Sakamoto, Shiojiri (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 13/783,717

(22) Filed: Mar. 4, 2013

(65) Prior Publication Data

US 2014/0002552 A1 Jan. 2, 2014

(30) Foreign Application Priority Data

Mar. 5, 2012 (JP) ..... 2012-047697

(51) Int. Cl.
*B41J 2/175* (2006.01)
*B41J 29/02* (2006.01)
*B41J 29/13* (2006.01)

(52) U.S. Cl.
CPC ..... *B41J 2/175* (2013.01); *B41J 2/17509* (2013.01); *B41J 29/02* (2013.01); *B41J 29/13* (2013.01)

(58) Field of Classification Search
CPC ..... B41J 2/17509; B41J 2/17553; B41J 2/17523; B41J 2/1752
See application file for complete search history.

(56) References Cited

U.S. PATENT DOCUMENTS

| | | | | |
|---|---|---|---|---|
| 5,909,226 | A | 6/1999 | Takeda | |
| 2005/0088494 | A1* | 4/2005 | Shimizu et al. | 347/85 |
| 2005/0151782 | A1 | 7/2005 | Ishida et al. | |
| 2005/0195252 | A1* | 9/2005 | Ishikawa et al. | 347/84 |
| 2007/0126816 | A1 | 6/2007 | Nishida | |
| 2007/0188565 | A1* | 8/2007 | Shimizu et al. | 347/85 |
| 2007/0229628 | A1* | 10/2007 | Yano | 347/86 |
| 2007/0256170 | A1* | 11/2007 | Hicks | 800/263 |
| 2008/0231674 | A1* | 9/2008 | Sugahara | 347/85 |
| 2009/0231399 | A1* | 9/2009 | Takemura et al. | 347/85 |
| 2009/0267986 | A1* | 10/2009 | Sugahara et al. | 347/21 |
| 2011/0025790 | A1* | 2/2011 | Serizawa et al. | 347/86 |
| 2013/0155450 | A1* | 6/2013 | Higashikawa | 358/1.15 |

FOREIGN PATENT DOCUMENTS

| | | |
|---|---|---|
| CN | 2825289 | 10/2006 |
| JP | 9-086014 | 3/1997 |

(Continued)

OTHER PUBLICATIONS

International Search Report dated Jun. 6, 2013 for PCT/JP2013/001285.

*Primary Examiner* — Shelby Fidler
*Assistant Examiner* — Tracey McMillion
(74) *Attorney, Agent, or Firm* — Workman Nydegger

(57) ABSTRACT

A liquid containing body 110 arranged inside the liquid ejecting apparatus main body 2; and a liquid supply tube 120 arranged between the liquid containing body 110 and the carriage, in which an inner space S is provided which is formed from the liquid ejecting head and a discharge port including a region where the recording medium is discharged, and the liquid containing body 110 is arranged in the inner space S.

12 Claims, 12 Drawing Sheets

(56) References Cited

FOREIGN PATENT DOCUMENTS

| | | |
|---|---|---|
| JP | 10-217496 | 2/1998 |
| JP | 2003-200597 | 7/2003 |
| JP | 2003-289406 | 10/2003 |
| JP | 2004-345247 | 12/2004 |
| JP | 2006-035662 | 2/2006 |
| JP | 2007-152725 | 6/2007 |

* cited by examiner

LIQUID EJECTING APPARATUS

TECHNICAL FIELD

The present invention relates to a liquid ejecting apparatus ejecting a liquid onto a recording medium from a liquid ejecting head mounted on a carriage.

BACKGROUND ART

An ink jet printer has been widely known as a liquid ejecting apparatus ejecting a liquid onto a recording medium from a liquid ejecting head.

The inkjet printer includes a carriage and a recording head mounted on the carriage. The ink jet printer performs printing on a recording sheet by ejecting an ink (liquid) from a nozzle formed on the recording head while moving the carriage to perform scanning with respect to the recording sheet (recording medium).

The ink jet printer includes one in which an ink cartridge supplying the ink to the recording head is mounted on the carriage (on-carriage type). The ink cartridge is detachably attached to the carriage.

In the on-carriage type ink jet printer, there is a limit to the capacity of the ink in the ink cartridge. Frequent replacements of the ink cartridge are required when attempting to perform a relatively large volume of printing, which causes the increase in running cost.

An apparatus has been proposed which arranges a large size ink tank outside the ink jet printer and supplies the ink from the ink tank to the carriage. In place of the ink cartridge, an attachment is mounted on the carriage. The ink is supplied from the ink tank to the attachment via a tube. This enables a large volume of printing (refer to PTL 1).

CITATION LIST

Patent Literature

[PTL 1] Chinese Examined Utility Model Registration Application Publication No. 2825289

SUMMARY OF INVENTION

Technical Problem

In the technology disclosed in PTL 1, a large size ink tank for all available colors is arranged laterally outside of an ink jet printer main body. A tube is laid across a carriage from a side portion of the ink jet printer main body.

In a case of arranging the ink tank outside the ink jet printer main body, it is necessary for the ink jet printer main body to secure a route for the tube by performing an additional process. Therefore, there is a problem in that defects are likely to occur in the ink jet printer main body. In addition, when arranging all the colors outside the ink jet printer main body, there is also a problem in that it requires a user who rarely uses color printing to have an additional large space outside the ink jet printer main body.

The invention aims to optimize a tube arrangement route arranged between the ink tank and the carriage as a first object, when additionally arranging the ink tank for the ink jet printer main body and further aims to optimize the tube arrangement route for the user who rarely uses the color printing as a second object when a large size ink tank is prepared for black color only.

Solution to Problem

A liquid ejecting apparatus according to the invention includes a liquid ejecting apparatus main body ejecting a liquid onto a recording medium from a liquid ejecting head mounted on a carriage; and a liquid supply tube that introduces the liquid supplied from a liquid containing body which contains the liquid to the liquid ejecting head, having a transformable moving unit which is transformed following the movement of the liquid ejecting head, in which an inner space is provided which is formed from a discharge port including a region where the recording medium is discharged, and the liquid containing body is arranged in the inner space.

The discharge port is configured to have a sheet discharge region and a space other than the sheet discharge region.

The liquid containing body is arranged in a region overlapped with a transportation route of the recording medium.

The liquid ejecting apparatus further includes a tube fixing member laid along a scanning direction of the liquid ejecting head, in which a portion of the liquid supply tube is fixed to the tube fixing member, and the liquid supply tube is laid across between the tube fixing member and the carriage.

The tube fixing member is a member with a flat plate shape.

The liquid ejecting apparatus further includes an ink placement table having a flat plate section arranged above the transportation route of the recording medium, in which the liquid containing body is placed on the flat plate section.

The ink placement table has leg portions supporting the flat plate section at both end sides in the scanning direction of the carriage, and the ink placement table is arranged across the sheet discharge region from the region other than the sheet discharge region.

The inner space is exposed from an upper surface opening of an apparatus housing which covers the liquid ejecting apparatus main body, at both end sides in the scanning direction of the carriage, the ink placement table has a suspending section that suspends the flat plate section from the upper surface opening to the inner space, and the ink placement table is arranged by suspending the sheet discharge region from the region other than the sheet discharge region.

A plurality of the liquid containing bodies is provided, and a plurality of the liquid containing bodies is arranged along the scanning direction of the carriage.

A plurality of the liquid containing bodies is provided, and a plurality of the liquid containing bodies is arranged along the transportation direction.

A plurality of the liquid containing bodies is provided, and a plurality of the liquid containing bodies is arranged along a vertical direction.

A plurality of the liquid containing bodies is provided, a portion of a plurality of the liquid containing bodies is arranged in the inner space, and remaining portion of the liquid containing bodies is arranged outside the liquid ejecting apparatus main body.

The liquid ejecting apparatus further includes an operation unit having a tilting mechanism on a front surface at the discharge port side of the liquid ejecting apparatus main body, in which the operation unit is fixed in a tilted state.

The liquid ejecting apparatus further includes an operation unit on a front surface at the discharge port side of the liquid ejecting apparatus main body, in which the operation unit is provided with a cover body arranged above the liquid ejecting apparatus main body.

An image reader reading out an image of the recording medium is arranged to be closely mountable above the liquid ejecting apparatus main body, and the inner space is formed on a region overlapped with the image reader.

A liquid ejecting apparatus includes a carriage reciprocating, being provided with a liquid ejecting head ejecting a liquid onto a recording medium; a liquid ejecting apparatus main body containing the carriage; and a liquid containing body containing the liquid supplied to the liquid ejecting head, communicating with the liquid ejecting head via a liquid tube, in which the carriage includes an adapter to which an opposite side of the liquid tube to the liquid containing body is connected and which communicates with the liquid ejecting head, and a liquid container storing the liquid to be supplied to the liquid ejecting head.

The liquid containing body is mounted on the inner space inside the liquid ejecting apparatus main body.

The liquid containing body is mounted on the outside of the liquid ejecting apparatus main body.

DESCRIPTION OF EMBODIMENTS

[First Embodiment]

A multi-function printer 1 according to a first embodiment of the invention will be described.

Hereinafter, in each drawing, a transportation direction (sub-scanning) of a recording sheet P represents an X direction, a scanning direction (horizontal direction) of a carriage 81 represents a Y direction and a vertical direction represents a Z direction.

For convenience, a downstream side (+X direction) in the transportation direction of the recording sheet P (recording medium) is referred to as forward and an upstream side (−X direction) is referred to as rearward. In the Y direction, the +Y direction is referred to as a left side and the −Y direction is referred to as a right side. In the Z direction, the +Z direction is referred to as upward and the −Z direction is referred to as downward.

Figure 1:
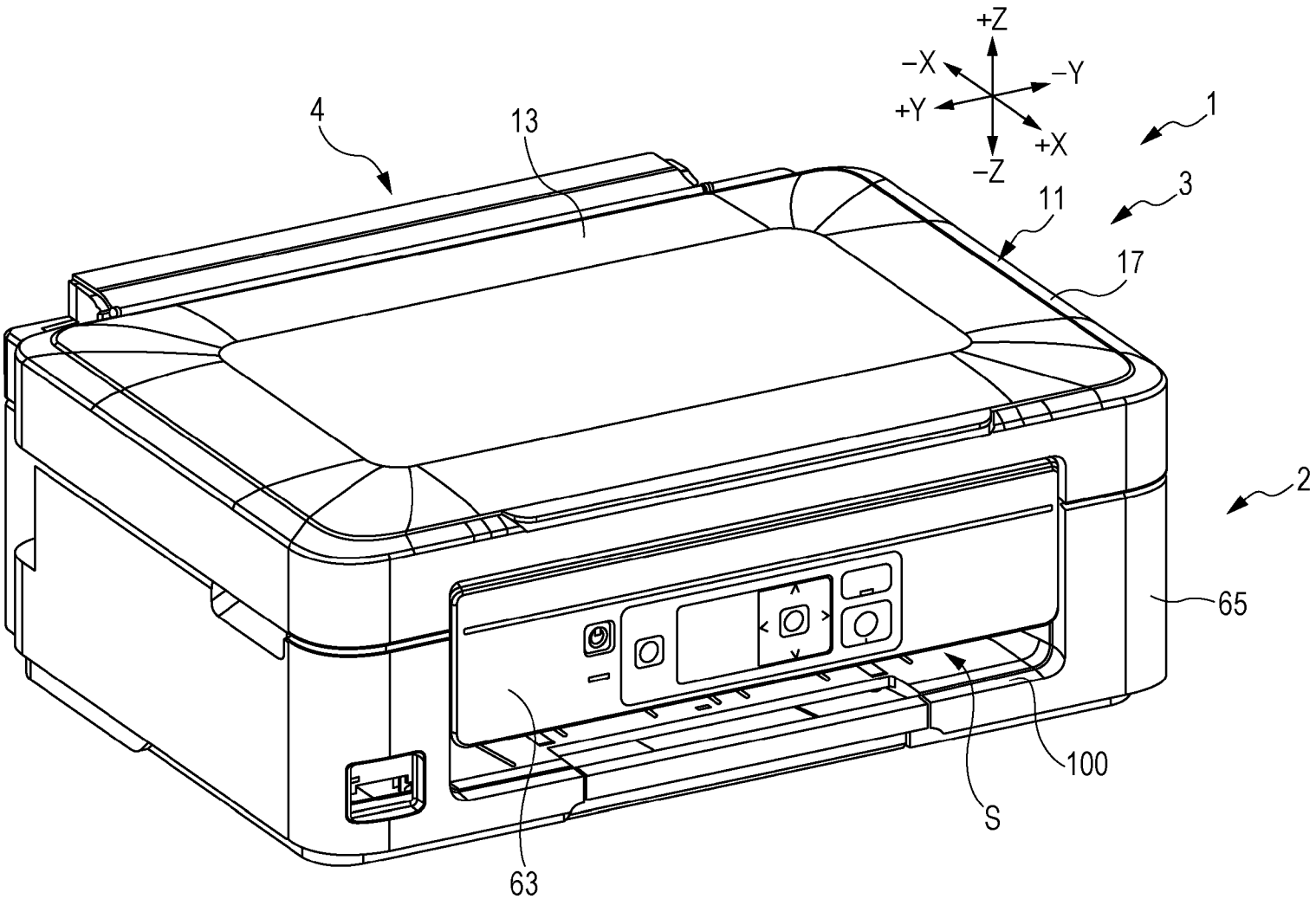
FIG. 1 is a perspective appearance view illustrating a multi-function printer 1 according to a first embodiment of the invention.
Figure 2:
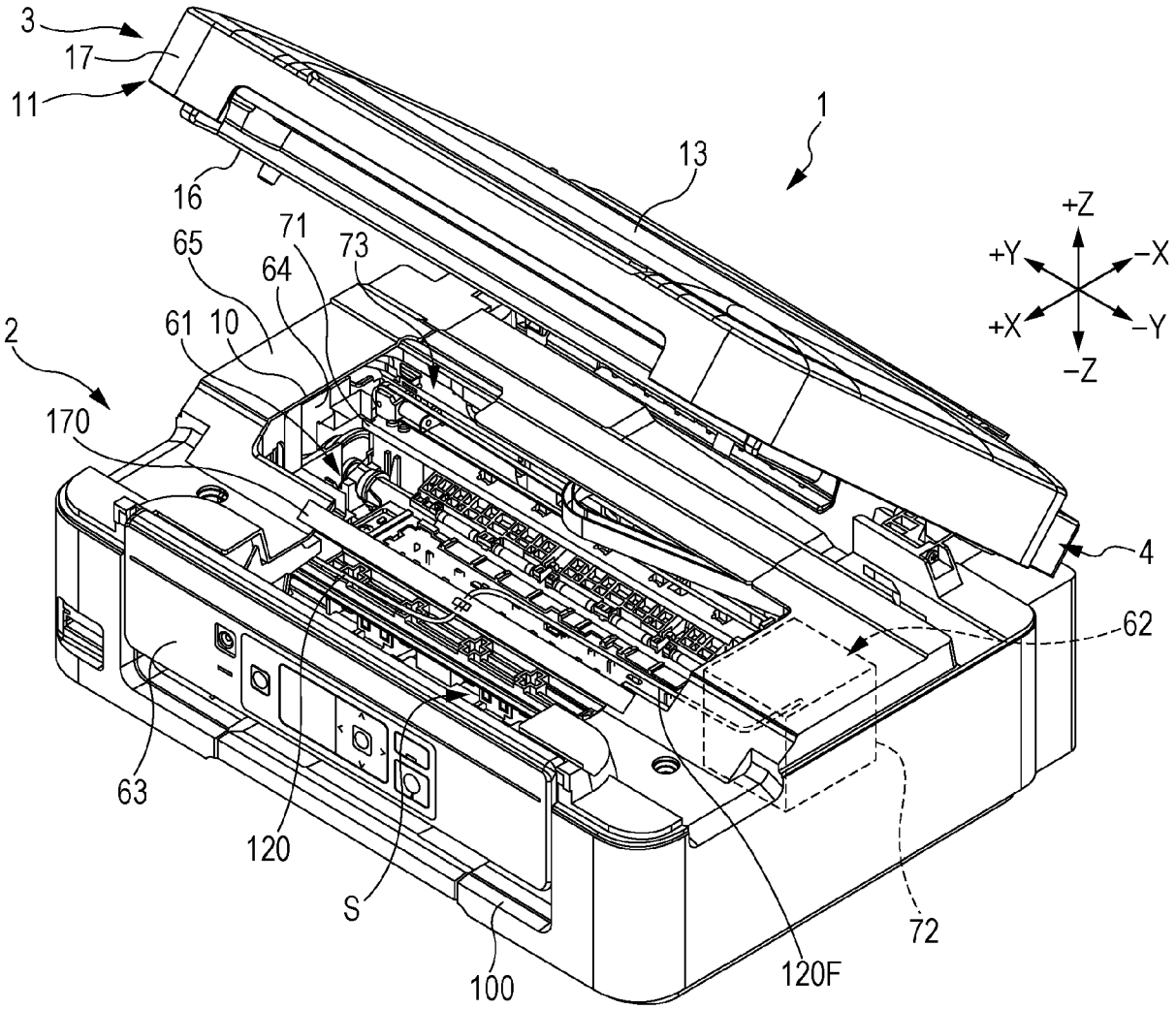
FIG. 2 is a perspective view illustrating the multi-function printer 1 when a scanner unit 3 is in an open state.

FIG. 1 is a perspective appearance view illustrating the multi-function printer 1 according to the first embodiment of the invention. FIG. 2 is a perspective view illustrating the multi-function printer 1 when a scanner unit 3 is in an open state.

The multi-function printer (liquid ejecting apparatus) 1 integrally includes a printer unit 2 which is an apparatus main body, and a scanner unit 3 which is an upper unit arranged above the printer unit 2.

As illustrated in FIG. 2, the multi-function printer 1 includes an ink container (liquid containing body) 110 inside (front inside space S) the printer unit 2.

The scanner unit 3 is pivotally supported by the printer unit 2 through an opening/closing unit 4 at a rear end portion, and covers an upper section of the printer unit 2 to be capable of opening/closing.

As illustrated in FIG. 2, if the scanner unit 3 is raised in a pivoting direction, an upper surface opening 10 of the printer unit 2 is exposed. This exposes the inside of the printer unit 2 from the upper surface opening 10.

On the other hand, if the scanner unit 3 is pulled down in the pivoting direction and placed on the printer unit 2, the scanner unit 3 closes the upper surface opening 10.

In this manner, if the scanner unit 3 is raised and the upper surface opening 10 is exposed, a paper jam and the like may be resolved.

The scanner unit 3 includes an upper frame 11 made of resins, an image reader (not illustrated) contained in the upper frame 11 and an upper cover 13 pivotally supported by an upper portion of the upper frame 11.

Configuring members of the scanner unit 3 side of the opening/closing unit 4 is disposed at a rear end portion of the upper frame 11.

The upper frame 11 includes a box type lower case 16 containing the image reader (not illustrated), and an upper case 17 covering a top side of the lower case 16.

A manuscript placement plate made of glass is widely arranged on the upper case 17 (not illustrated). A reading medium whose reading surface faces downward is placed on the manuscript placement plate.

The image reader (not illustrated) contained in the lower case 16 includes a line sensor type sensor unit (not illustrated). The sensor unit has an image sensor (sensor portion) which is a Charge Coupled Device (CCD) type line sensor extending in the X direction, and reciprocates in the Y direction. This enables the image of the reading medium (manuscript) to be read on the manuscript placement plate.

As the image sensor, a Complementary Metal Oxide Semiconductor (CMOS) type line sensor may be used.

The printer unit (liquid ejecting apparatus main body) 2 includes a transportation unit 61 transporting a sheet of the recording sheet P along a transportation route R, a printing unit 62 arranged above the transportation route R, performing a printing process on the recording sheet P by way of an ink jet method, a panel type operation unit 63 arranged on a front surface, an apparatus frame 64 on which the transportation unit 61, the printing unit 62 and the operation unit 63 are mounted, and an apparatus housing 65 covering these.

Figure 3:
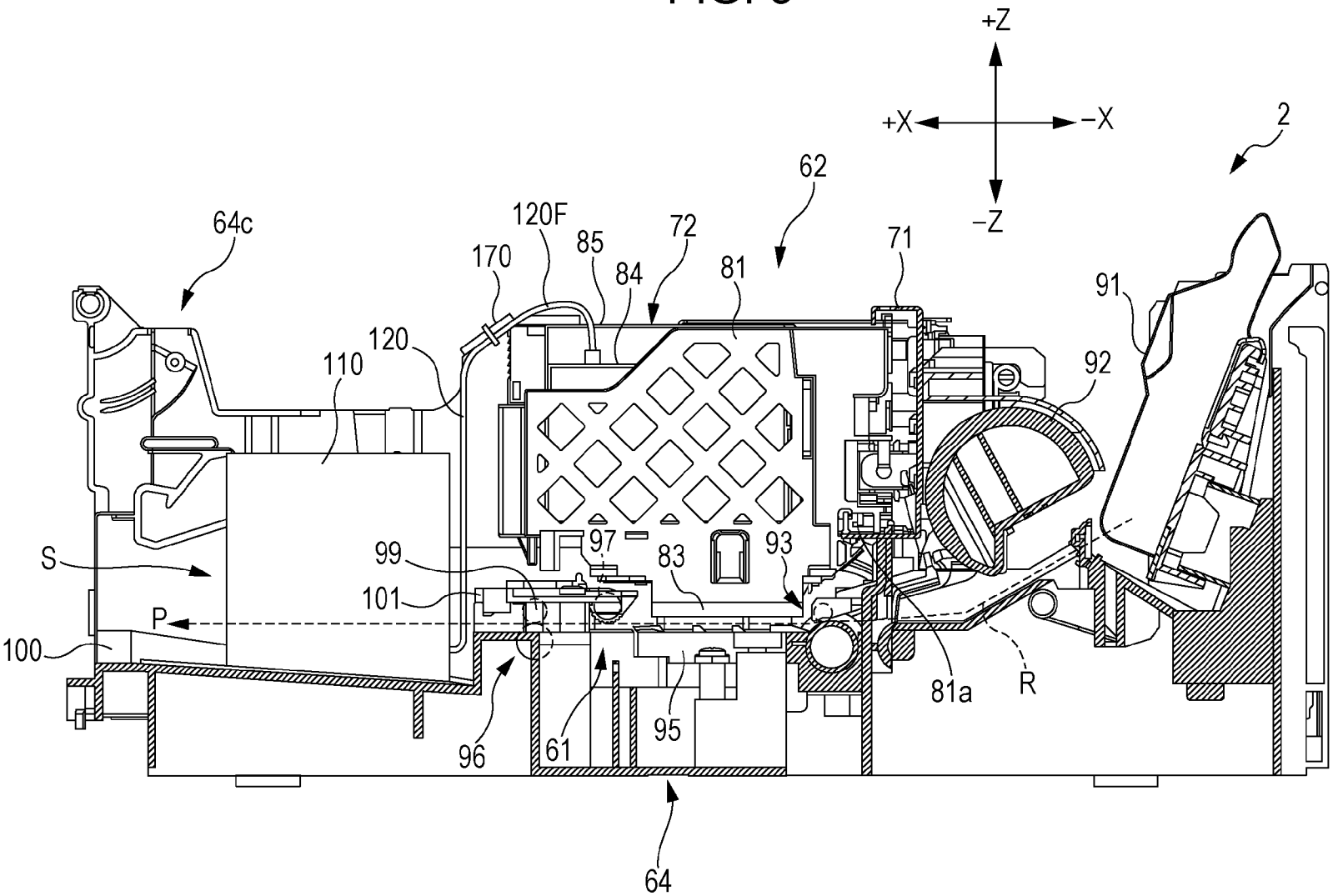
FIG. 3 is a cross-sectional view in a side view, illustrating an internal structure of a printer unit 2 and an arrangement route for a tube 120.

FIG. 3 is a cross-sectional view in a side view, illustrating an internal structure of the printer unit 2 and an arrangement route for a tube 120.

The printing unit 62 includes a guide frame 71 made of sheet metal, supporting the apparatus frame 64 and fully extending to a width in the Y direction, a carrier unit 72 supported by the guide frame 71 to freely reciprocate, and a carriage moving mechanism 73 (refer to FIG. 2) allowing the carriage unit 72 to reciprocate along the guide frame 71.

The carriage unit 72 includes a box shaped carriage 81 supported by the guide frame 71 to freely reciprocate through an engagement slider portion 81*a*, an ink jet head 83 integrally incorporated on a lower surface of the carriage 81, and four ink cartridges (ink cartridge 85 with one ink cartridge adapter 84 and three liquid containers) contained in the carriage 81 to be attachable and detachable.

The ink jet head (liquid ejecting head) 83 has four nozzle rows (not illustrated) ejecting four colors of ink drops. Four cartridges (ink cartridge adapter 84 and ink cartridge 85) storing the four colors of ink are mounted on the carriage 81. Four cartridges (ink cartridge adapter 84 and ink cartridge 85) are directly connected to an upper surface side of the ink jet head 83.

The ink cartridge adapter 84 is supplied with a black ink from an ink container 110 (to be described later). Three ink cartridges 85 store cyan, magenta and yellow inks, respectively.

The transportation unit 61 includes a movable type sheet tray 91 setting the recording sheet in a right alignment manner, a separation roller 92 sending one by one by separating the recording sheet P from the sheet tray 91, a feed roller 93 located downstream from the separation roller 92 and sending the recording sheet P to the printing unit 62 along the transportation route R, a medium regulating member 95 located downstream from the feed roller 93 and opposing the ink jet head 83, a serrated guide roller 97 located downstream from the medium regulating member 95, and a sheet discharge roller 96 located downstream from the guide roller 97 and sending the recording sheet P from a discharge port 100 (refer to FIG. 2).

The medium regulating member 95 is equivalent to a so-called platen.

The recording sheet P sent from the sheet tray 91 by the separation roller 92 is intermittently fed toward the sheet discharge roller 96 in the X direction over the medium regulating member 95 by the feed roller 93 (sub-scanning).

In synchronization with this intermittent feeding, the carriage unit 72, reciprocating in the X direction, selectively ejects the ink (main scanning) to perform desired printing.

A leading edge of the recording sheet P reaching the guide roller 97 over the medium regulating member 95 is subjected to correction of a dished state using the guide roller 97 so as to be sent to the sheet discharge roller 96.

In this manner, the printing completed recording sheet P is sent forward from the discharge port 100 by the sheet discharge roller 96.

Figure 4:
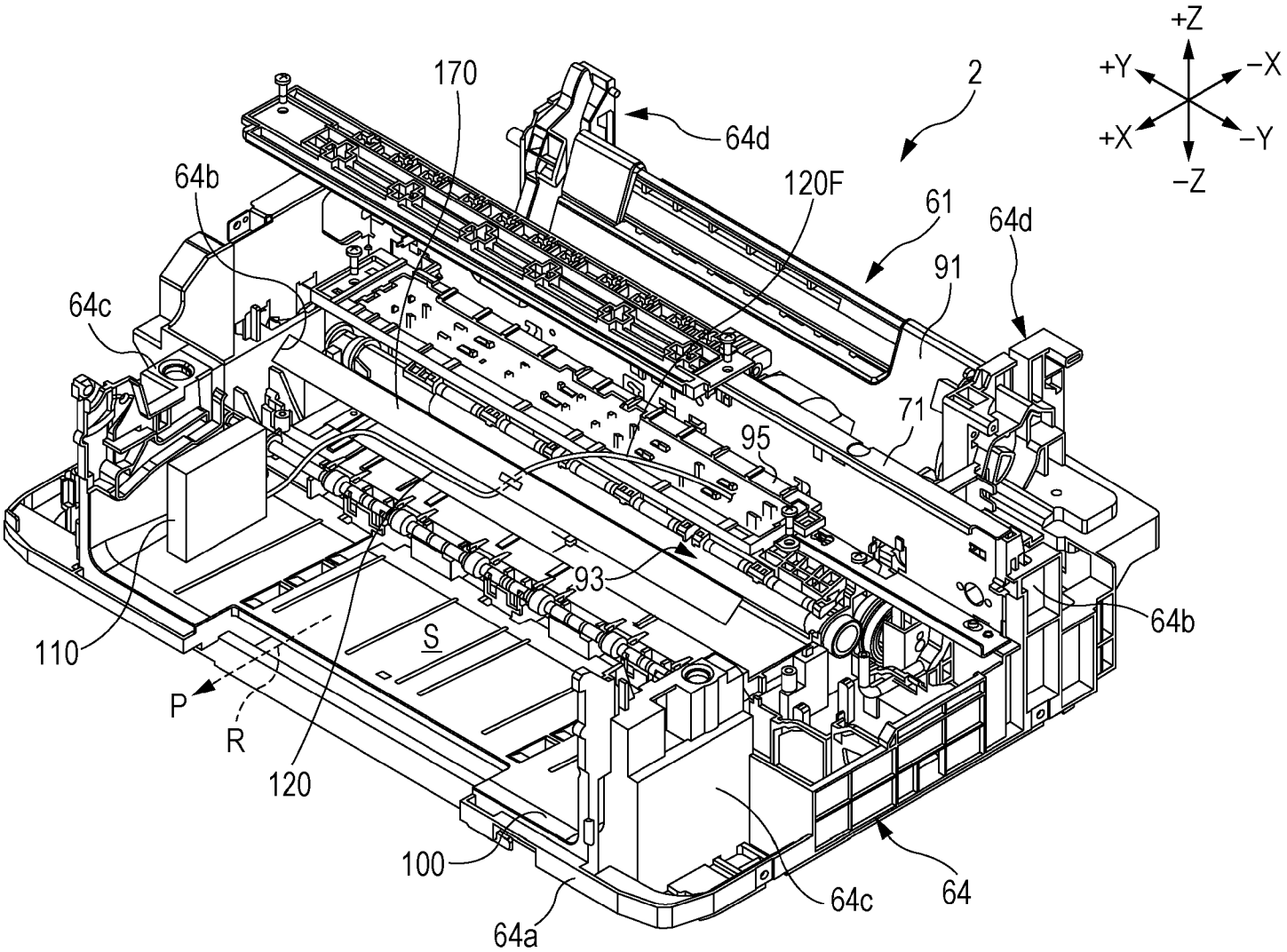
FIG. 4 is an exploded perspective view illustrating the internal structure of the printer unit 2 and the arrangement route for the tube 120.

FIG. 4 is an exploded perspective view illustrating the internal structure of the printer unit 2 and the arrangement route for the tube 120.

Figure 5:
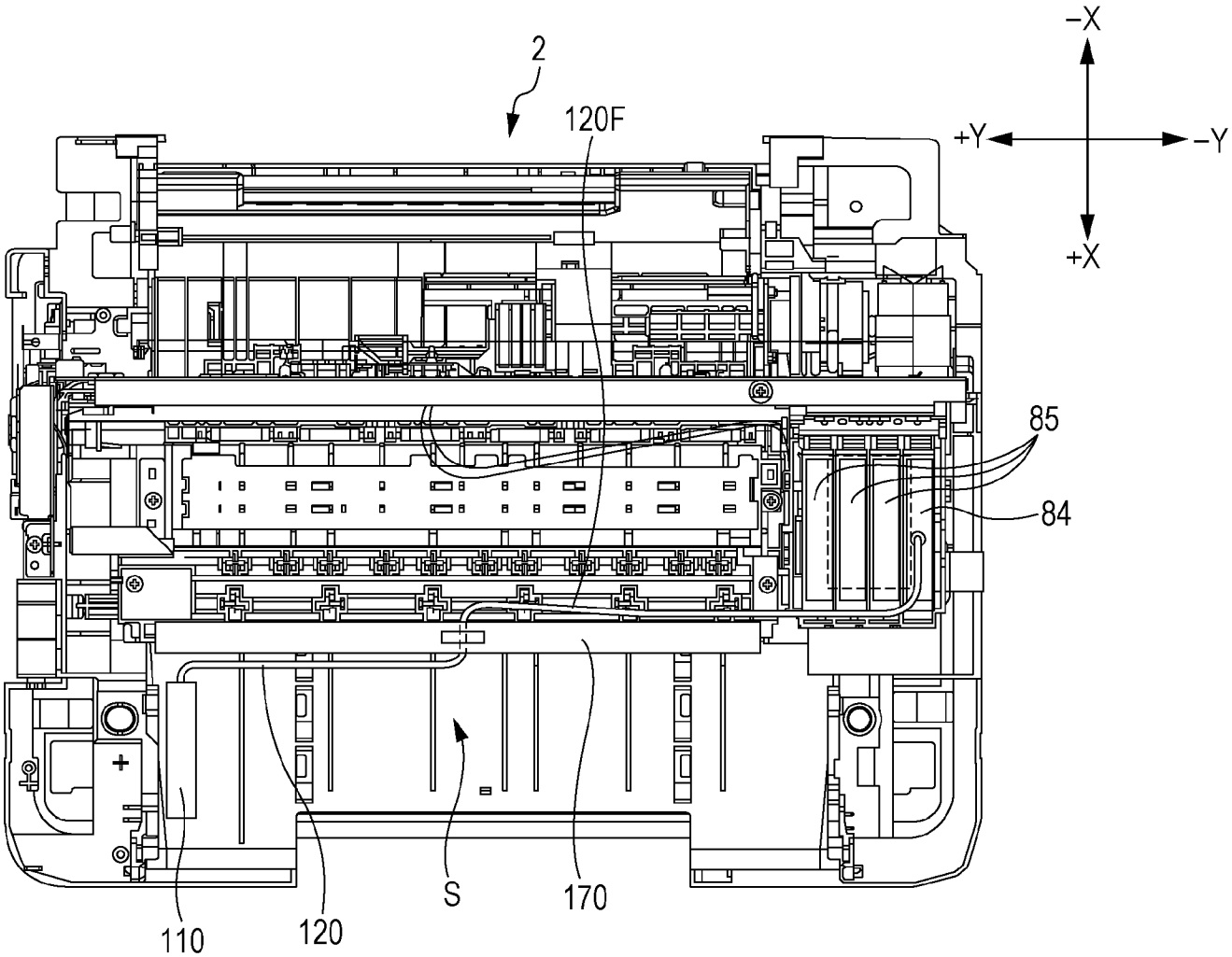
FIG. 5 is a top view illustrating the internal structure of the printer unit 2 and the arrangement route for the tube 120.

FIG. 5 is a top view illustrating the internal structure of the printer unit 2 and the arrangement route for the tube 120.

The apparatus frame 64 is a frame supporting each portion of the printer unit 2, and is configured to have integrally molded resins.

The apparatus frame 64 includes a base frame portion 64*a*, a symmetrical pair of side frames portions 64*b*, a symmetrical pair of front frame portions 64*c* and symmetrical pair of rear frame portions 64*d*.

A symmetrical pair of the side frame portions 64*b* is erected at the base frame portion 64*a* and supports each configuring member of the transportation unit 61 and the guide frame 71 at both sides.

A symmetrical pair of the front frame portions 64*c* supports a front portion of the scanner unit 3 in a front portion of the base frame portion 64*a*, and supports the operation unit 63.

A symmetrical pair of the rear frame portions 64*d* supports the printer unit 2 to be capable of opening/closing through the opening/closing unit 4, in a rear portion of the base frame 64*a*.

A pair of the rear frame portions 64*d* is erected up to the outside of the apparatus housing 65 via a rear portion opening which is open at a rear portion of the apparatus housing 65. A pair of the rear frame portions 64*d* is formed from configuring members of the opening/closing unit 4 at the printer unit 2 side.

A sheet discharge frame 101 supporting a guide roller 97 and an auxiliary roller 99 is arranged at a front portion of the side frame portions 64*b*. The auxiliary roller (roller) 99 is arranged opposing the feed roller 96.

The sheet discharge frame (frame member) 101 is arranged forward (+X direction) from and below (−Z direction) the carriage 81. The sheet discharge frame 101 is horizontally laid along the scanning direction (Y direction) of the carriage 81 between a pair of the side frame portions 64*b*.

A relatively wide space (front inner space S) is formed between the sheet discharge frame 101 and the discharge port 100.

The ink container 110 storing the black ink is arranged in the front inner space S (refer to FIG. 2). An ink containing amount of the ink container 110 is equal to or more than the ink containing amount of the ink cartridge adapter 84 and the ink cartridge 85.

The ink container 110 is arranged at a left end of the front inner space S. Within the front inner space S, a left end region is a region which is not overlapped with the transportation route R of the recording sheet P. Therefore, even though the ink container 110 is arranged at the left end region of the front inner space S, there is no interference between the ink container 110 and the recording sheet P.

The ink container 110, even though arranged at a right end, has the same result.

The tubes 120 are arranged (tube-laid) for supplying the ink contained in the ink container 110 toward the ink cartridge adapter 84 between the ink container 110 and the ink cartridge adapter 84. The tubes (liquid supply tube) 120 are formed from one tube 121 supplying the black ink.

The tube 120 is fixed to a tube fixing member 170 attached to the apparatus housing 65 so as to be laid across the upper surface opening 10 between the ink container 110 and the ink cartridge adapter 84. Within the tube 120, a region between the tube fixing member 170 and the ink cartridge adapter 84 becomes a movable region 120F which is subjected to flexion deformity in association with a scanning movement of the carriage 81.

The tube fixing member 170 is a long flat plate shaped member extending in a left and right direction (refer to FIG. 4). The tube fixing member 170 is attached to the apparatus housing 65 so as to traverse horizontally over the upper surface opening 10 along the scanning direction (Y direction). The tube fixing member 170 is attached to the apparatus housing 65 so as to be laid across the left side and the right side of the apparatus housing 65 by pinching the upper surface opening 10. Both ends of the tube fixing member 170 are fixed to the apparatus housing 65 using an adhesive or adhesive tape.

The tube 120 formed from the tube 121 is fixed to the center of the tube fixing member 170 in the left and right direction.

The arrangement route (tube laying route) of the tubes 120 will be described along a direction (ink's flowing direction) from the ink container 110 toward the ink cartridge adapter 84 (to be described in order of FIGS. 2 and 5).

First, as illustrated in FIG. 2, the tubes 120 are laid across from the ink container 110 toward the center of the tube fixing member 170 in the left and right direction. The tubes 120 are fastened and fixed to the center of the tube fixing member 170 in the left and right direction using a fastening band and the like.

Furthermore, as illustrated in FIG. 5, the tubes 120 are once arranged toward the +Y direction after being fixed to the tube fixing member 170. Then, the tube 120 is folded back in a U shape and is inverted from the +Y direction to the −Y direction. The tubes 120 are vertically folded back in the U shape.

The tubes 120, after being inverted in the −Y direction, are fixed on the upper surface of four ink cartridge adapters 84 contained in the carriage 81. The tubes 120 are fixed on the upper surface of the ink cartridge adapters 84 using the fastening band and the like. Then, the tubes 120 are connected to the respective ink cartridge adapters 84.

Within the tubes 120, a region bent to the U shape becomes the movable region 120F which is subjected to flexion deformity in association with the scanning movement of the carriage 81. A length of the movable region 120F is adjusted so as not to interfere with the scanning movement of the carriage 81.

[Modification Example for Arranging Ink Containers 110]

Figure 6:
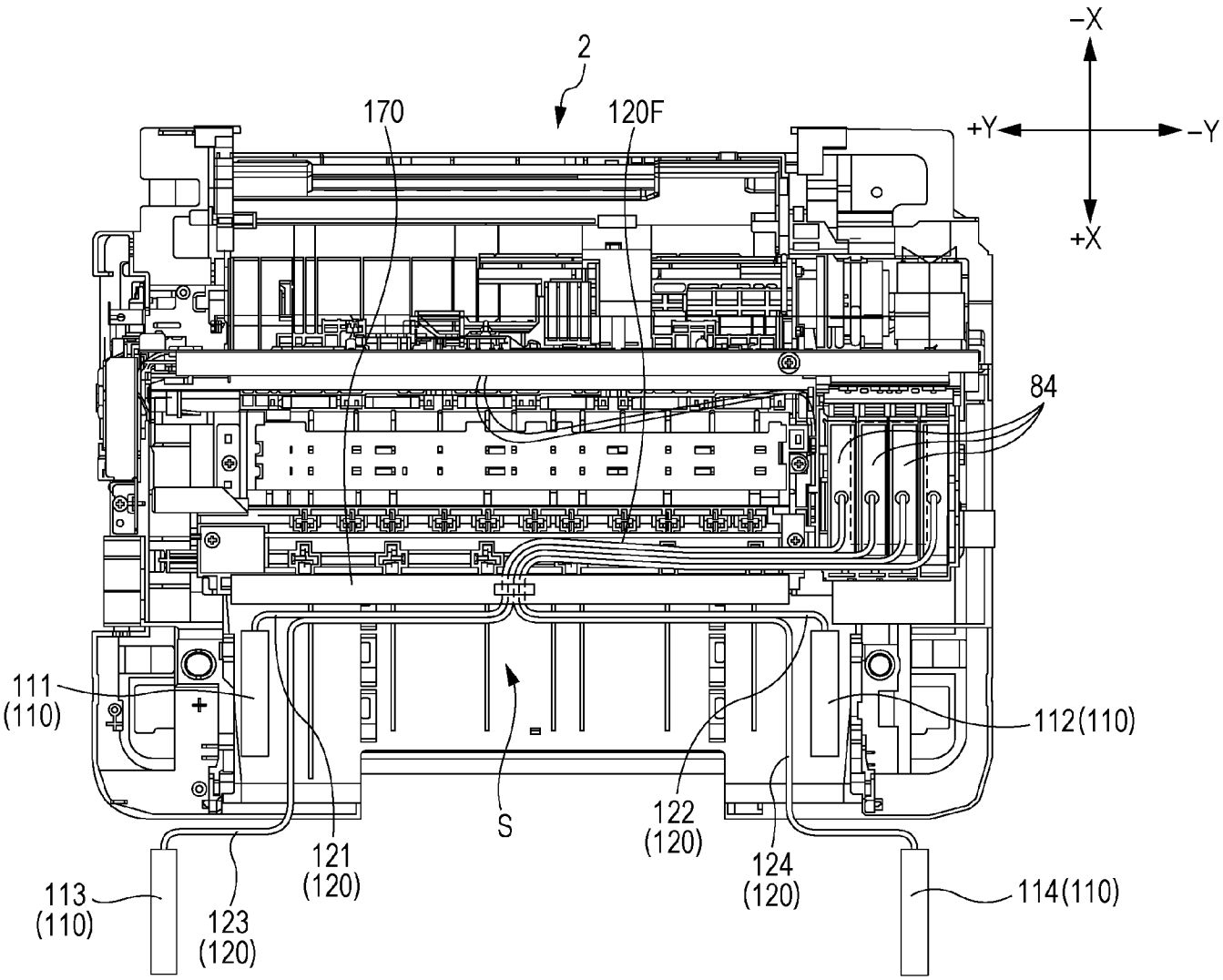
FIG. 6 is a view illustrating a modification example for arranging ink containers 110.

FIG. 6 is a view illustrating a modification example for arranging ink containers 110.

In the front inner space S, the ink containers 110 (ink container 111 to 114) storing the black, cyan, magenta and yellow inks may be arranged partially or entirely.

Four ink cartridge adapters 84 are contained in the cartridge 81 to be attachable and detachable. The tubes 120 (four tubes 121 to 124) are arranged (tube-laid) between the four ink cartridge adapters 84 and the ink containers 110 (four ink containers 111 to 114).

In the ink containers 110, the ink container 111 is arranged at a left end of the front inner space S. The ink container 112 is arranged at a right end of the front inner space S. The ink containers 113 and 114 are arranged in front which is an outside region of the printer unit 2.

A combination of the ink containers 110 contained in the front inner space S with the ink containers 110 arranged outside the printer unit 2 may be modified. All the ink containers 110 may be contained in the front inner space S.

The tubes 121 and 122 connected to the ink containers 111 and 112 are respectively laid across toward the center of the tube fixing member 170 in the left and right direction. The tubes 123 and 124 connected to the ink containers 113 and 114 are respectively laid across toward the center of the tube fixing member 170 in the left and right direction after passing through the discharge port 100.

The tubes 120 formed from the four tubes 121 to 124 are fixed to the center of the tube fixing member 170 in the left and right direction.

As described above, in the multi-function printer 1 according to the first embodiment, the front inner space S of the printer unit 2 contains the ink containers 110. Thus, it is hardly necessary to perform additional processing on the printer unit 2. Since the distance is short between the ink containers 110 and the carriage 81, it is possible to easily secure the arrangement route of the tubes 120, whereby optimizing the arrangement route of the tubes 120.

Figure 12:
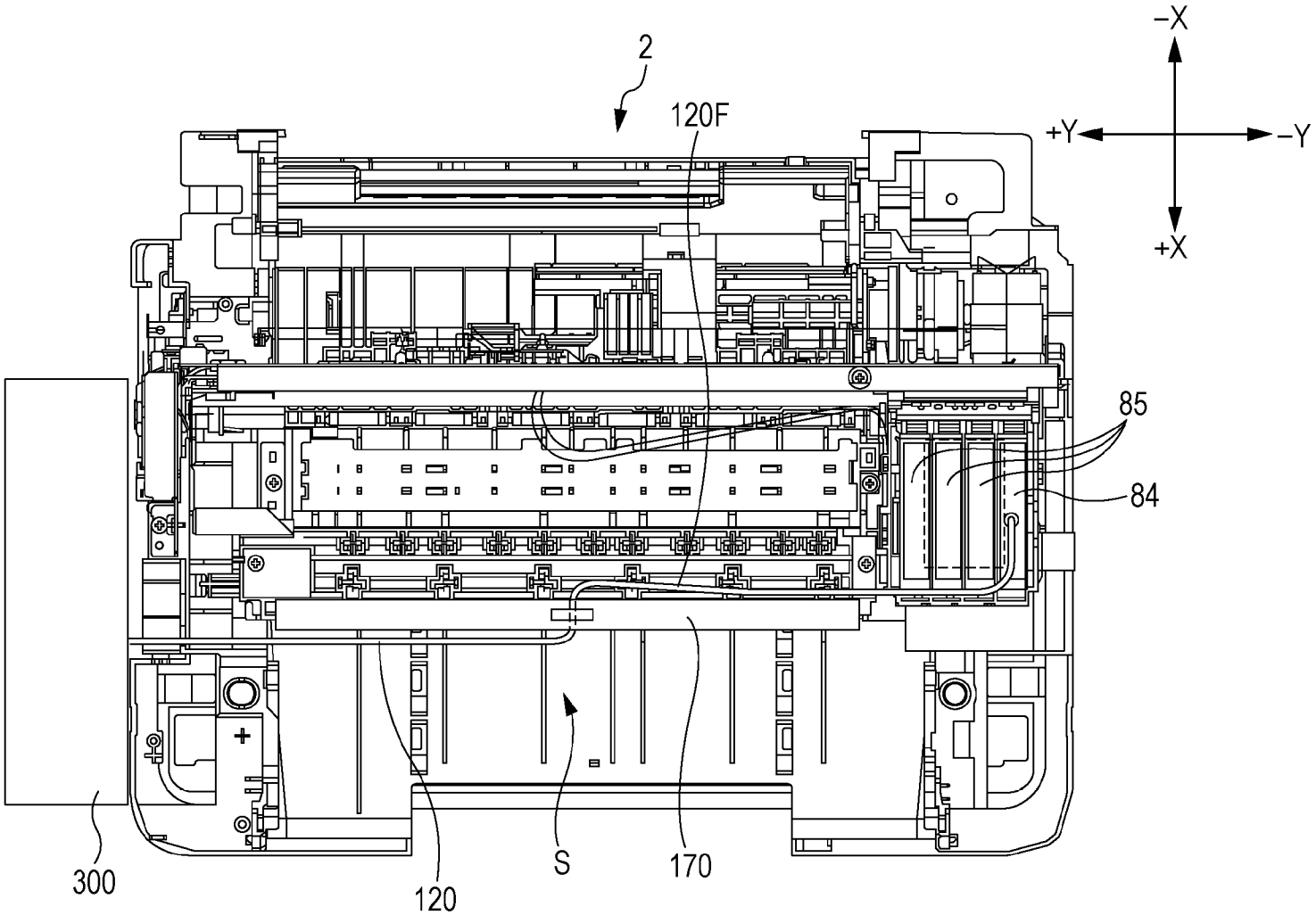
FIG. 12 is a top view of the printer unit 2 and an ink container 300.

Without arranging the ink container inside the apparatus housing 65, the ink container may be arranged outside the printer unit 2 only. FIG. 12 is a top view of the printer unit 2 and an ink container 300. The ink container 300 containing the black ink is arranged outside the printer unit 2. The ink containing amount of the ink container 300 is equal to or more than the ink containing amount of the ink cartridge adapter 84 and the ink cartridge 85.

The tubes 120 are fixed to the fixing member 170 between the ink container 300 and the ink cartridge adapter 84. Within the tubes 120, a region between the tube fixing member 170 and the ink cartridge adapter 84 becomes the movable region 120F which is subjected to flexion deformity in association with the scanning movement of the carriage 81.

[Second Embodiment ]

A multi-function printer 201 according to a second embodiment of the invention will be described. The same reference numerals are given to the same configurations and members as those of the multi-function printer 1 according to the first embodiment, and the same description will not be repeated.

Figure 7:
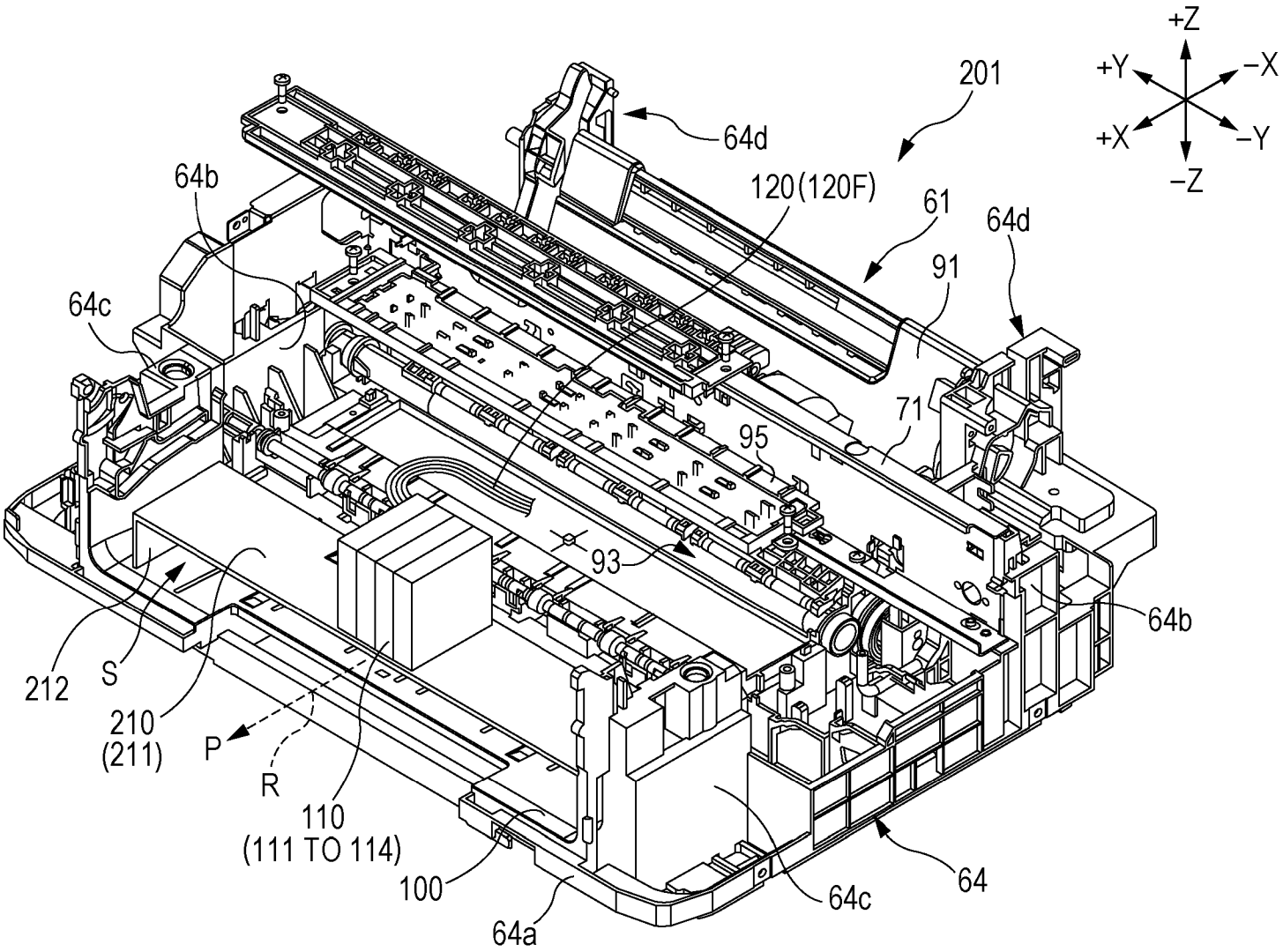
FIG. 7 is an exploded perspective view illustrating the internal structure of a multi-function printer 201 and the arrangement route for the tube 120 according to a second embodiment of the invention.

FIG. 7 is an exploded perspective view illustrating the internal structure of the multi-function printer 201 and the arrangement route for the tubes 120 according to the second embodiment of the invention.

In the front inner space S, an ink placement table 210 is arranged where four of the ink containers 110 (ink containers 111 to 114) are placed.

The ink placement table 210 has a long flat plate section 211 extending in the left and right direction and two leg portions 212 arranged across both ends of the flat plate section 211 in the left and right direction, and is formed using a bending process of sheet metal or the like.

A longitudinal direction of the flat plate section 211 is substantially coincident with a length of the front inner space S in the left and right direction. The length (height) of the two leg portions 212 is approximately 5 to 10 mm, for example.

The ink placement table 210 is arranged such that the flat plate section 211 horizontally crosses the front inner space S along the scanning direction (Y direction) and the two leg portions 212 face downward.

A space between a bottom surface of the front inner space S and the flat plate section 211 is the transportation route R of the recording sheet P. The ink placement table 210 is arranged across the transportation route R of the recording sheet P.

The four ink containers 110 are placed on an upper surface of the flat plate section 211. The four ink containers 110 are arranged at a region overlapped with the transportation route R of the recording sheet P, viewing from the top (viewing from the +Z direction).

The four ink cartridge adapters 84 are contained in the carriage 81 to be attachable and detachable. The tubes 120 (four tubes 121 to 124) are arranged (tube-laid) between the four ink cartridge adapters 84 and the ink containers 110 (four ink containers 111 to 114).

The four ink containers 111 to 114 are arranged in parallel so as to be overlapped with one another toward the left and right direction, on the upper surface of the flat plate section 211. The four ink containers 111 to 114 are overlapped in the thickness direction. The four ink containers 111 to 114 are fastened using the fastening band and the like.

The tubes 120 (tubes 121 to 124) connected to the four ink containers 111 to 114 are respectively and directly laid across toward the ink cartridge adapters 84 of the carriage 81. The tubes 120 are fixed on the ink cartridge adapters 84 using the fastening band. Then, the tubes 120 are respectively connected to the ink cartridge adapters 84.

All regions of the tubes 120 become the movable region 120F which is subjected to flexion deformity in association with the scanning movement of the carriage 81. The length of the movable region 120F is adjusted so as not to interfere with the scanning movement of the carriage 81.

[Modification Example for Arranging Ink Containers 110]

Figure 8:
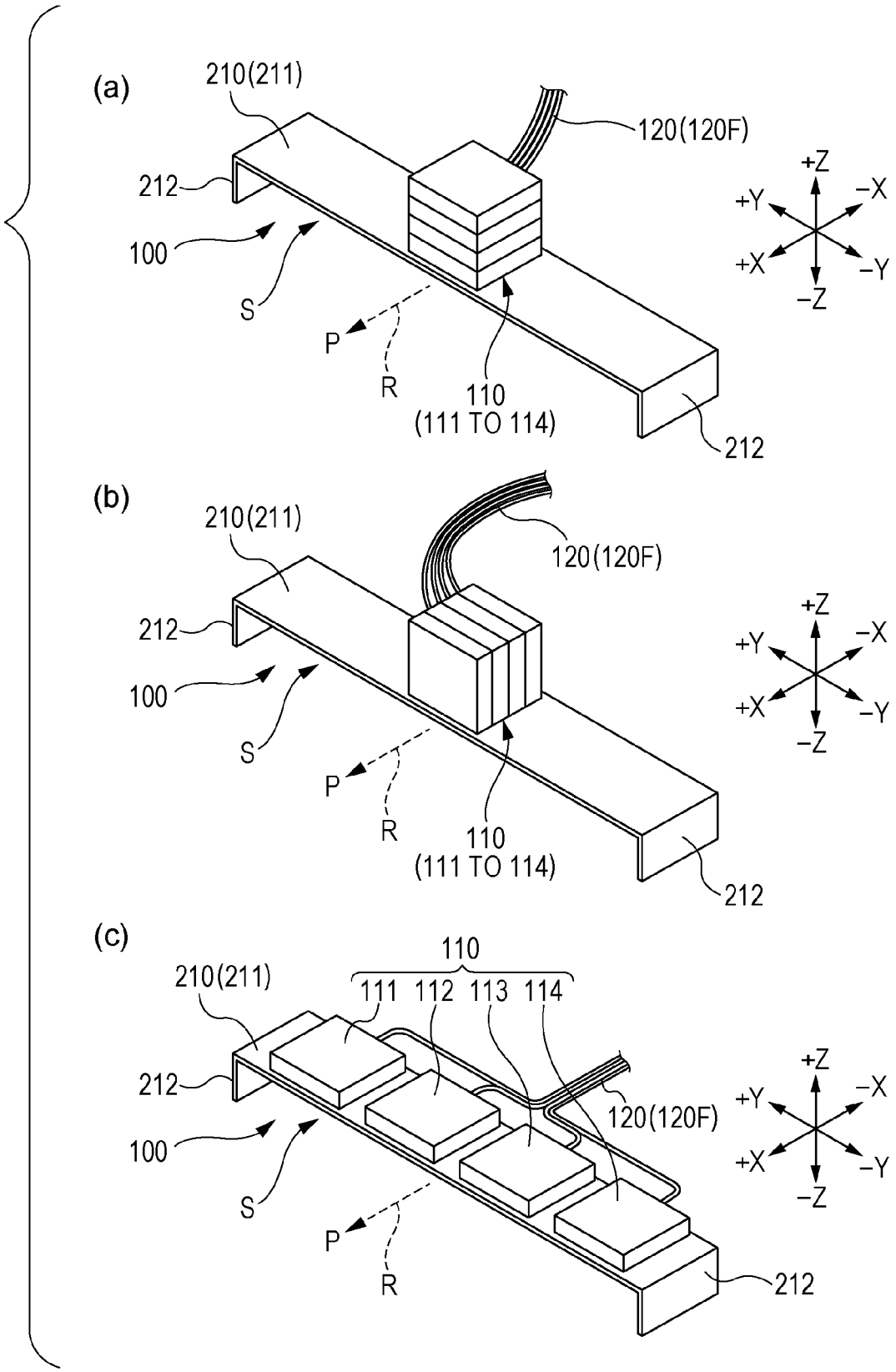
FIG. 8 is a view illustrating a modification example for arranging the ink container 110.

FIG. 8 is a view illustrating a modification example for arranging the ink containers 110. FIG. 8(*a*) is a view illustrating a case where the ink containers 110 are arranged by being vertically overlapped. FIG. 8(*b*) is a view illustrating a case where the ink containers 110 are arranged by being overlapped in the forward and backward direction. FIG. 8(*c*) is a view illustrating a case where the ink containers 110 are arranged by being overlapped (in parallel) toward the left and right direction in a direction different from the thickness direction.

The ink containers 110 (four ink containers 111 to 114) can be arranged in parallel so as to be overlapped with one another, vertically, toward the forward and backward direction or toward the left and right direction, on the upper surface of the flat plate section 211. Depending on the volume of the four ink containers 111 to 114, the arrangement direction and the overlapped direction may be appropriately set.

[Modification Example of Ink Placement Table]

Figure 9:
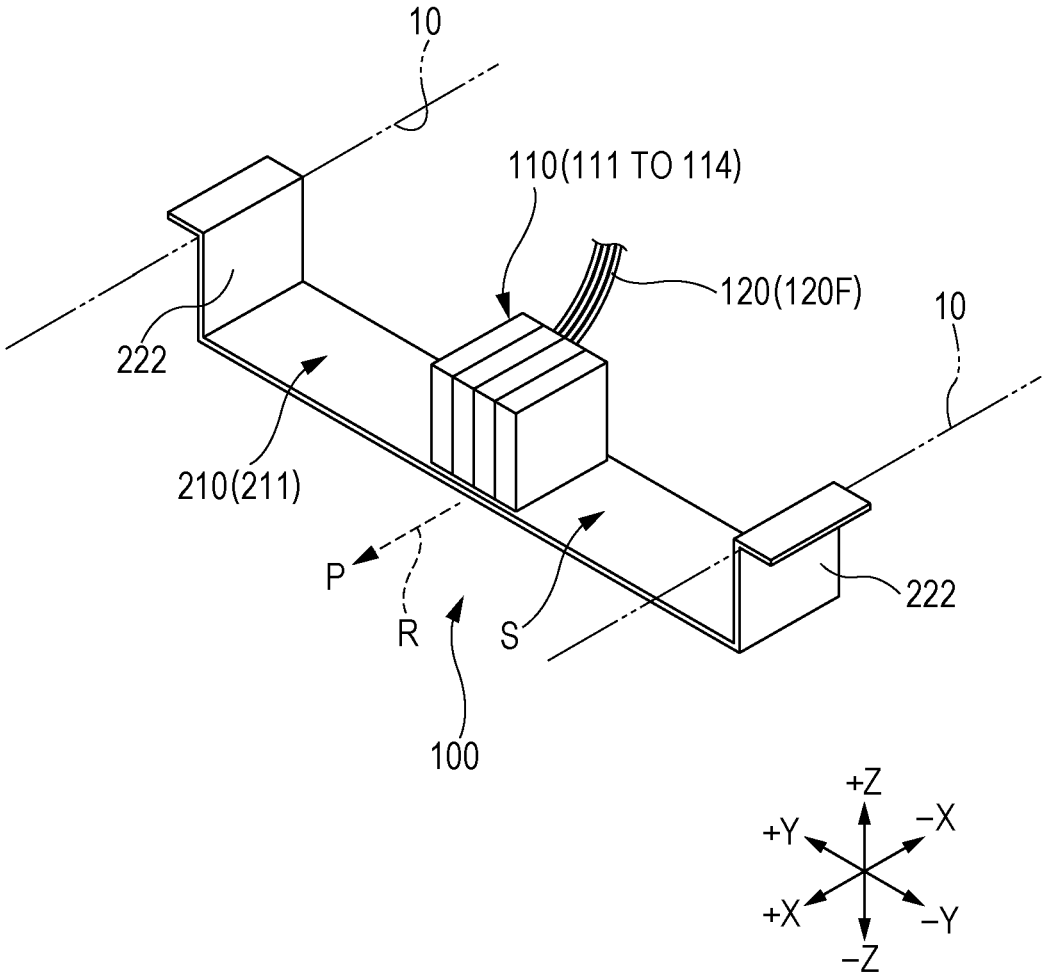
FIG. 9 is a view illustrating an ink placement table 220.

FIG. 9 is a view illustrating an ink placement table 220.

The ink placement table 220 is a modification example of the ink placement table 210. In place of the ink placement table 210, the ink placement table 220 may be used.

The ink placement table 220 has a flat plate section 221 which has the same shape as the flat plate section 211 of the ink placement table 210.

In contrast, unlike the ink placement table 210, there are provided two suspending sections 222 which are bent upward at both ends of the flat plate section 211 in the left and right direction. The two suspending sections 222 have a shape hooked by edges of the upper surface opening 10 which exposes the front inner space S.

The ink placement table 220 is arranged such that the flat plate section 221 horizontally crosses the front inner space S along the scanning direction (Y direction) and the two suspending sections 222 face upward. Since the two suspending sections 222 are hooked by the edges of the upper surface opening 10, the transportation route R of the recording sheet P is secured between the flat plate section 221 and the bottom surface of the front inner space S.

The four ink containers 110 are placed on the upper surface of the flat plate section 221. The four ink containers 110 are arranged at the region overlapped with the transportation route R of the recording sheet P, when viewed from the top (viewed from the +Z direction).

As described above, in the multi-function printer 201 according to the second embodiment, the same advantageous effects as the multi-function printer 1 according to the first embodiment may also be achieved. That is, the front inner space S of the printer unit 2 contains the ink containers 110. Thus, it is not necessary to perform additional processing on the printer unit 2. Since the distance is short between the ink containers 110 and the carriage 81, it is possible to easily secure the arrangement route of the tubes 120, whereby achieving the optimization of the arrangement route of the tubes 120.

Various shapes or combinations of the respective configuring members illustrated in the embodiments described above are merely an example, and can be diversely varied based on design requirements within the range without departing from the gist of the invention.

Figure 10:
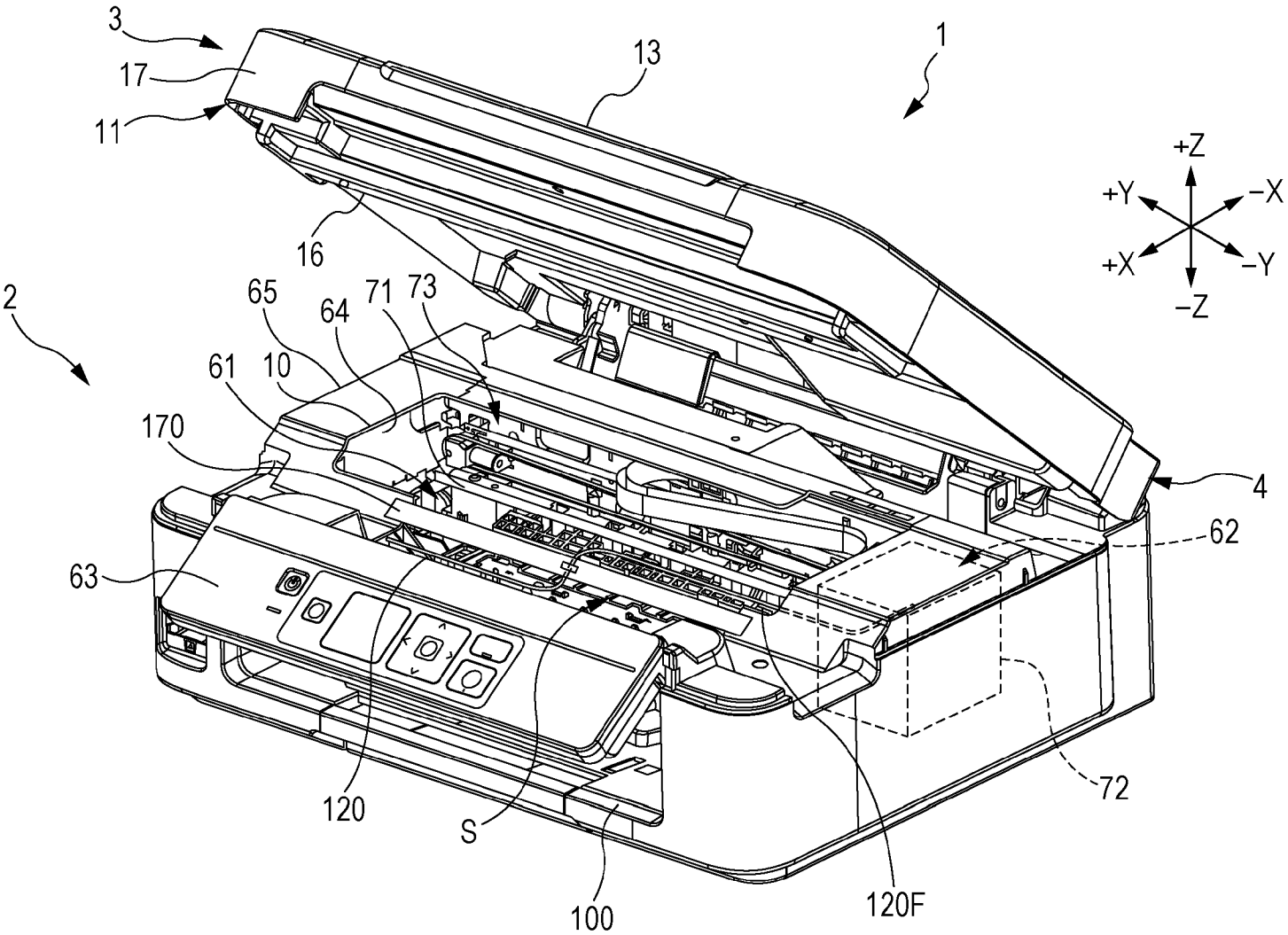
FIG. 10 is a view illustrating a state where an operation unit 63 is tilted forward.

FIG. 10 is a view illustrating a state where an operation unit 63 is tilted forward.

The multi-function printers 1 and 201 enable the operation unit 63 to be tilted forward. A tilting mechanism (not illustrated) for tilting the operation unit 63 forward is disposed at a rear surface side (rearward) of the operation unit 63. The operation unit 63 and the tilting mechanism are disposed above the discharge port 100. Accordingly, in a case where the operation unit 63 is tilted forward, the front inner space S becomes wider compared to a case where the operation unit 63 is in a vertical state.

Therefore, in the multi-function printers 1 and 201, the operation unit 63 is fixed by being tilted forward. In such a manner that the tilting mechanism cannot be operated, the largest tilting angle of the operation unit 63 is ensured.

This allows the front inner space S to be wider, and thereby enables more ink containers 110 to be disposed.

Figure 11:
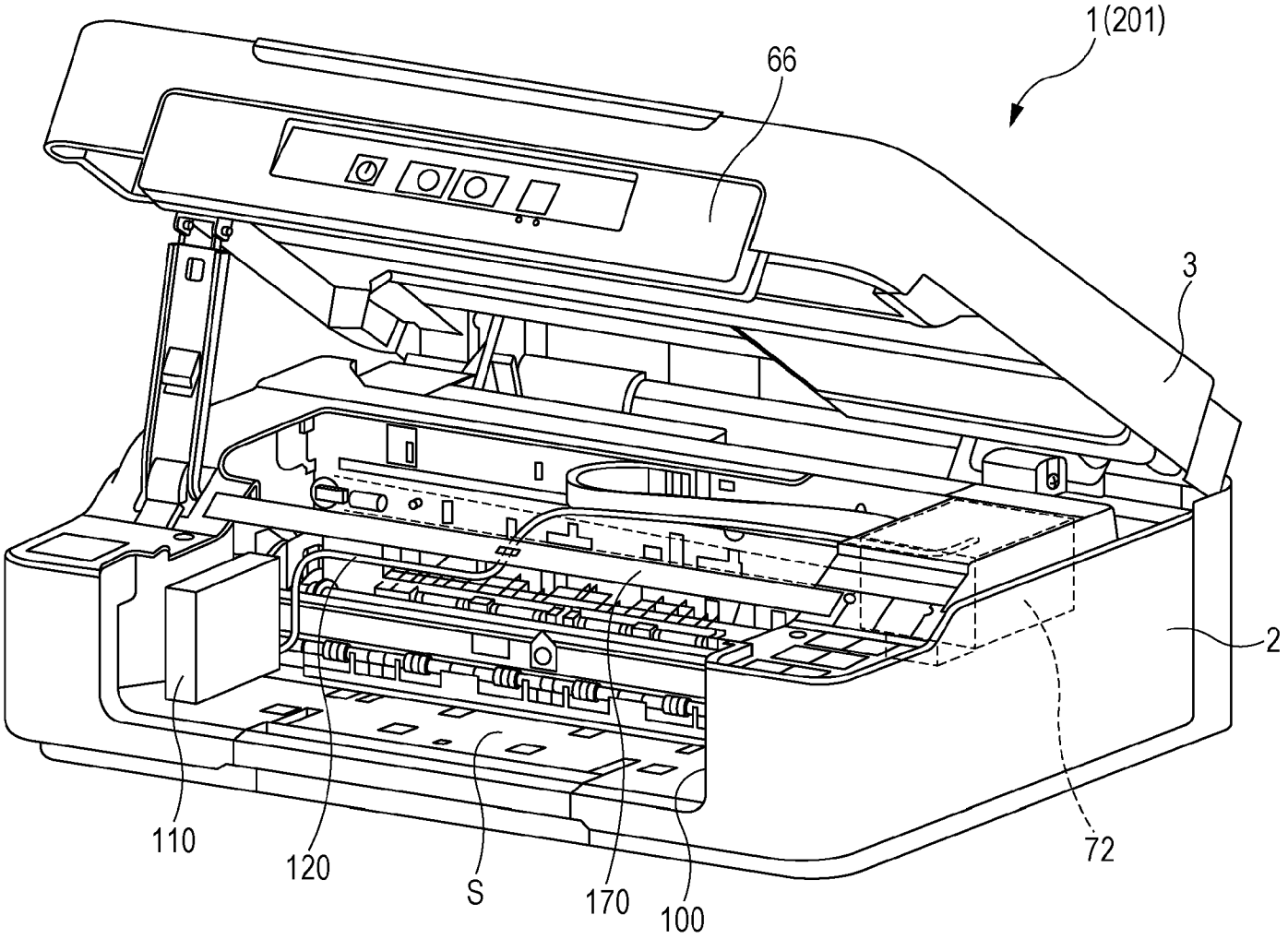
FIG. 11 is a view illustrating an operation unit 66 arranged on the scanner unit 3.

FIG. 11 is a view illustrating an operation unit 66 arranged on the scanner unit 3.

The multi-function printers 1 and 201 may be provided with an operation unit 66 arranged on the scanner unit 3 in place of the operation unit 63 arranged to be capable of tilting with respect to the printer unit 2.

The operation unit 66 arranged on the scanner unit 3 cannot be tilted with respect to the scanner unit 3. When the scanner unit 3 is closed, the operation unit 63 is in the vertical state.

When using the operation unit 66, it is not necessary to have the tilting mechanism which tilts the operation unit 66 forward. Therefore, as compared to when using the operation unit 63, the front inner space S becomes wider.

This allows the front inner space S to be wider, and thereby enables more ink containers 110 to be disposed.

The number of the ink containers 110 is not limited to four and the number of the tubes 120 is not limited to four. The number of the ink containers 110 may be six and the number of the tubes 120 may be six.

The carriage 81 may not allow the ink cartridge adapter 84 to be mounted thereon, and may be configured such that the ink is directly supplied from the ink containers 110 via the tubes 120.

The apparatus having the ink containers 110 is not limited to the liquid ejecting apparatus, and may be an apparatus consuming the liquid.

By way of an example as the liquid ejecting apparatus, the liquid ejecting apparatus ejecting the liquid such as the ink has been described, but may be applied to the liquid ejecting apparatus ejecting or discharging other liquid except for the ink. The liquid which the liquid ejecting apparatus can eject includes a liquid body, where functional material particles are dispersed or dissolved, and a liquid body in a gel.

The liquid ejected from the liquid ejecting apparatus is not limited to the ink only, but is also applicable to the liquid corresponding to particular uses.

REFERENCE SIGN LIST

1, 201: multi-function printer (liquid ejecting apparatus)
2: printer unit (liquid ejecting apparatus main body)
3: scanner unit (cover body, image reader)
10: upper surface opening
63, 66: operation unit
81: carriage
83: ink jet head (liquid ejecting head)
84: ink cartridge adapter
100: discharge port
110, 300: ink container (liquid containing body)
120: tube (liquid supply tube)
170: tube fixing member
210: ink placement table
211: flat plate section
212: leg portion
220: ink placement table
221: flat plate section
222: suspending section
P: recording sheet (recording medium)

R: transportation route

S: front inner space (inner space)

The present application claim priority from Japanese Patent Application No. 2012-047697 filed on Mar. 5, 2012, which is expressly incorporated by reference herein.

The invention claimed is:

1. A liquid ejecting apparatus comprising:

a liquid ejecting apparatus main body ejecting a liquid onto a recording medium from a liquid ejecting head mounted on a carriage; and a liquid supply tube that introduces the liquid supplied from a liquid containing body which contains the liquid to the liquid ejecting head, having a transformable moving unit which is transformed following the movement of the liquid ejecting head, wherein an inner space has an opening that discharges the recording medium, wherein an ink placement table having a flat plate section is arranged above the transportation route of the recording medium in the inner space, and wherein the liquid containing body is placed on the flat plate section, wherein the ink placement table is arranged across the sheet discharge region from the region other than the sheet discharge region.

2. The liquid ejecting apparatus according to claim 1, wherein the ink placement table has leg portions supporting the flat plate section at both end sides in the scanning direction of the carriage.

3. The liquid ejecting apparatus according to claim 1, wherein the inner space is exposed from an upper surface opening of an apparatus housing which covers the liquid ejecting apparatus main body, wherein at both end sides in the scanning direction of the carriage, the ink placement table has a suspending section that suspends the flat plate section from the upper surface opening to the inner space, and wherein the ink placement table is arranged by suspending the sheet discharge region from the region other than the sheet discharge region.

4. The liquid ejecting apparatus according to claim 1, wherein a plurality of the liquid containing bodies is provided, and the plurality of the liquid containing bodies is arranged along the scanning direction of the carriage.

5. The liquid ejecting apparatus according to claim 1, wherein a plurality of the liquid containing bodies is provided, and the plurality of the liquid containing bodies is arranged along the transportation direction of the recording medium.

6. The liquid ejecting apparatus according to claim 1, wherein a plurality of the liquid containing bodies is provided, and the plurality of the liquid containing bodies is arranged along a vertical direction.

7. The liquid ejecting apparatus according to claim 1, wherein a plurality of the liquid containing bodies is provided, a portion of a plurality of the liquid containing bodies is arranged in the inner space, and a remaining portion of the liquid containing bodies is arranged outside the liquid ejecting apparatus main body.

8. The liquid ejecting apparatus according to claim 1, wherein an operation unit on a front surface at a discharge port side of the liquid ejecting apparatus main body has a tilting mechanism, wherein the operation unit is fixed in a tilted state.

9. The liquid ejecting apparatus according to claim 8, wherein the operation unit is disposed in a cover body arranged above the liquid ejecting apparatus main body.

10. The liquid ejecting apparatus according to claim 1, wherein an image reader reading out an image of the recording medium is arranged to be closely mountable above the liquid ejecting apparatus main body, and wherein the inner space is formed on a region overlapped with the image reader.

11. The liquid ejecting apparatus according to claim 1, wherein the recording medium is discharged by a sheet discharge roller, the inner space being configured to be downstream of the sheet discharge roller in the sheet discharge direction.

12. A liquid ejecting apparatus according to claim 1, wherein the ink placement table has leg portions supporting the flat plate section at both end sides in the scanning direction of the carriage.

* * * * *